United States Patent [19]

Achterwinter et al.

[11] Patent Number: 4,886,219

[45] Date of Patent: Dec. 12, 1989

[54] WINDING UP A FOIL WEB, PARTICULARLY A FOIL WEB OF SYNTHETIC MATERIAL

[75] Inventors: Norbert Achterwinter, Hilden; Wolfgang Hax, St. Augustin, both of Fed. Rep. of Germany

[73] Assignee: Reifenhauser GmbH & Co. Maschinenfabrik, Troisdorf, Fed. Rep. of Germany

[21] Appl. No.: 215,018

[22] Filed: Jul. 5, 1988

[30] Foreign Application Priority Data

Jul. 3, 1987 [DE] Fed. Rep. of Germany ..... 3721968

[51] Int. Cl.[4] ..... B65H 19/20; B65H 19/26

[52] U.S. Cl. ..... 242/58.6; 242/65

[58] Field of Search ..... 242/56 R, 58.6, 65, 242/66

[56] References Cited

U.S. PATENT DOCUMENTS

| | | | |
|---|---|---|---|
| 2,920,836 | 1/1960 | De Bell | 242/65 |
| 3,585,779 | 6/1971 | Thayer et al. | 242/56 R X |
| 3,610,545 | 10/1971 | Reifenhauser et al. | 242/56 R X |
| 3,848,824 | 11/1974 | Van Schijndel | 242/65 X |

*Primary Examiner*—Joseph J. Hail, III
*Assistant Examiner*—Steven M. duBois
*Attorney, Agent, or Firm*—Herbert Dubno

[57] ABSTRACT

A device for winding up a foil web, particularly a foil web of synthetic material, into a foil roll on a roll core, has two swivel arms having roll-core receiving portions at their ends, a contact roller, and an actuating cylinder-piston arrangement for the swivel arms and the roll core drive. The swivel arms are swung according to the indication of the increasing diameter of the foil roll. In the area of the contact roller, a winding device with two swingable winding arms is arranged. A roll-core magazine is assigned thereto, having two magazine disks, which are oppositely located and rotatable about a horizontal axis and have corresponding receiving portions for the roll-core ends. To each magazine disk, a basically L-shaped guiding element is assinged which on the vertical flank of the L has an arched leading edge following the path of the roll-core receiving portions, which—over an assembly trough—continues with a downwardly inclined level which is a discharge edge. The winding device has winding arms swingable about a horizontal axis, which for the purpose of introducing a new roll core coming from underneath, grasp the ends of a roll core located in the assembly trough with their receiving ends and, by entraining the magazine disks and by winding the sectioned foil web over the inclined plane, bring it into contact with the contact roller, where the swivel arms of the device receive the roll core, whereby a further roll core of the roll-core magazine reaches the assembly trough.

1 Claim, 2 Drawing Sheets

FIG. I

WINDING UP A FOIL WEB, PARTICULARLY A FOIL WEB OF SYNTHETIC MATERIAL

FIELD OF THE INVENTION

The invention relates specifically to a device for winding up a foil web, particularly a foil web of synthetic material. In particular, the invention relates to a winding apparatus into a foil roll on a roll core, with two swivel arms having at their ends receiving portions for the roll core, a contact roller, actuating -cylinder pistons arrangement for the swivel arms and the roll core drive, whereby the foil web is guided between contact roller and roll core, respectively foil roll and the swivel arms, at least one of which is provided with the roll core drive, are swung in accordance with the indication of the increasing diameter of the foil roll and wherein a contact pressure can be established between the contact roller and the roll core, respectively the foil roll along the swivel path of the swivel arms by means of the actuating-cylinder pistons arrangement, and whereby in the area of the contact roller a winding device with two swingable winding arms is provided, with a winding magazine assigned thereto, this magazine having two oppositely located magazine disks, rotatable about a horizontal axis, with corresponding receiving portions for the ends of the roll core.

BACKGROUND OF THE INVENTION

In the earlier devices of this kind, the winding magazine is provided with its own drive, which moves the magazine disks, step by step, for instance each by 90° in such a manner that the roll cores lying in the roll-core receiving portions are successively brought to the winding device and received by it, when a foil roll is finished and it is necessary to prepare the winding operation for a new foil roll. It is self-understood that the foil web then must be separated by a sectioning device, that the trailing end of the foil web resulted from the sectioning has to exit the device with the foil roll and that the leading edge of the remaining foil web has to be wound around the new roll core. For this purpose, the winding arms have to be properly moved. All this is cumbersome and requires correspondingly synchronizable drives and controls. Generally, the roll cores are introduced manually into the receiving portions of the magazine disks.

OBJECT OF THE INVENTION

It is the object of the invention to develop this type of device so that the introduction of a new roll core in the device with the aid of the roll-core magazine can be performed especially simply from the point of view of driving and control techniques.

SUMMARY OF THE INVENTION

This object is achieved according to the invention by providing each magazine disk with a basically L-shaped guide element. On the vertical shank of the L, an arched leading edge is provided which follows the path of the roll-core receiving portions, which continues -via an assembly trough- with a discharge area, which is downwardly inclined. The winding device is provided with winding arms, swingable about a horizontal axis and which engage the ends of a roll core in the assembly trough for the purpose of engaging a new roll core from underneath. The magazine disks are rotated and the sectioned foil web passes over the inclined surface.

Swivel arms of the device receive the roll core, and a further roll core from the roll-core magazine reaches the assembly trough.

It is self-understood that the two magazine disks are generally mounted on a common shaft. According to the invention, the roll-core magazine is entrained by the winding device, namely by the winding arms. Therefore it does not require a special drive. The required synchronization is automatically established.

BRIEF DESCRIPTION OF THE DRAWING

The above and other objects, features and advantages of the present invention will become more readily apparent from the following description, reference being made to the accompanying drawing in which.

DESCRIPTION

Figure 1:
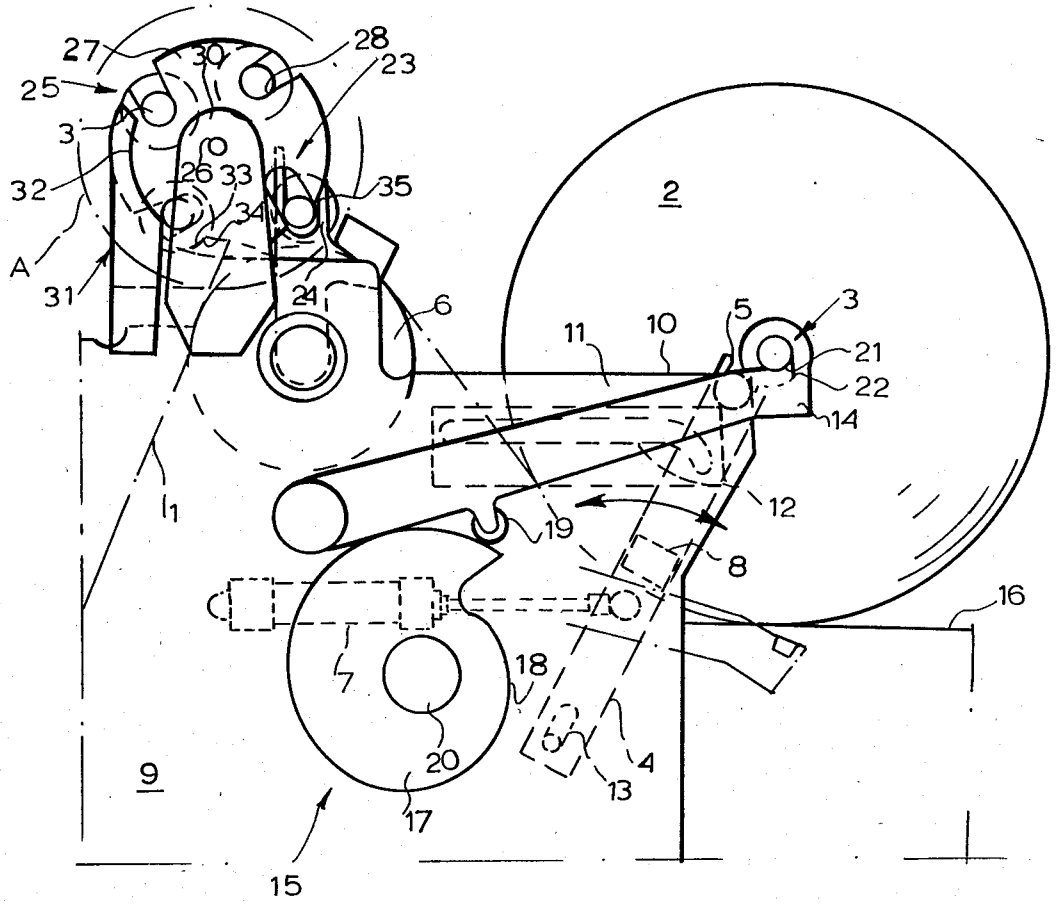
FIG. 1 is a lateral view of the device of the invention.

The device illustrated in the figures serves for winding up a foil web 1, particularly a foil web of synthetic material, into a foil roll 2 on a roll core 3. Two swingable arms 4 are formed at their ends with receiving portions 5 for the roll core. A contact roller 6, at least one actuating-cylinder pistons arrangement 7 for the swingable arms 4 and a roll core drive 8 are also provided.

The above-described parts and assemblies are mounted in a corresponding machine frame 9. The arrangement is such that the foil web 1 is guided between the contact roller 6 and the roll core 3 or the foil roll 2 thereon, and that the swingable arms 4, at least one of which is provided with the roll core drive 8, can be swung in accordance with the indication of the increasing diameter of the foil roll 2. By means of the actuating-cylinder pistons 7, a contact pressure is produced along the path of the swingable arms 4, indicated by a double arrow, between the contact roller 6 and the roll core 3, respectively the foil roll 2, with the interposition of the foil web 1. For this purpose, the arrangement is such that along the swinging path of the swingable roll-winding arms 4, a support guide rail 10 is provided. On this, the ends of the roll core 3 are supported, of course in such a way that they can be set in rotation independently of this support. The described arrangement makes it possible to design the swivel arms 4 solely as a device for producing contact pressure and to provide it with a corresponding actuating-cylinder piston arrangement 7. The latter makes possible to keep the contact pressure accurately constant, and, if necessary, to set it at various values. In the embodiment shown and in a preferred embodiment of the invention, the support guide rails 10 are the upper edges of mutually parallel lateral walls 11. The side walls 11 contribute to the stability of the machine frame 9. The swingable arms 4 are guided on the one side, namely at the top, in the coulisse 12 and on the other side, namely at the bottom, are swingably supported in the oblong slot 13, so that the roll-core receiving portions 5 are guided on the level of the support guide rail 10, when the swingable arms 4 perform their swinging motion. It is also possible to design the swivel arms 4 as two-armed levers, balanced by counterweights.

From FIG. 1, it can be discerned that the roll core 3 with the finished foil roll 2 can be received at its ends by the lowering arms 14 and can be deposited on a discharge ramp 16 with the aid of a lowering-arm drive 15. The lowering arms 14 can again be raised with the aid of the lowering-arm drive 15.

The lowering-arm drive 15 has for each of the lowering arms a lowering cam plate 17. These lowering cam plates 17 are identically shaped and congruently mounted and provided with outer edges 18 having the shape of a FIG. 6 and which mathematically corresponds to a plane spiral. The lowering arms 14 are guided with a guide or cam-follower roller 19 on the respective edge 18. The lowering cam plates 17 are driven by an electromotor not shown in the drawing. The installation is designed in its details so that the edges 18 correspond to an equal-torque cam, as already explained above. As a result, the lowering cam plates 17 can be driven by a relatively small three-phase geared motor. In the embodiment shown, the cams 17 are set on the common shaft 20. In their receiving position for the roll core 3, with the finished foil roll 2, shown in solid lines in FIG. 1, the lowering arms 14 reach over the support guide rail 10 with receiving claws 12. They are activatable through limit switches 22, which are mounted in this area.

Figure 2:
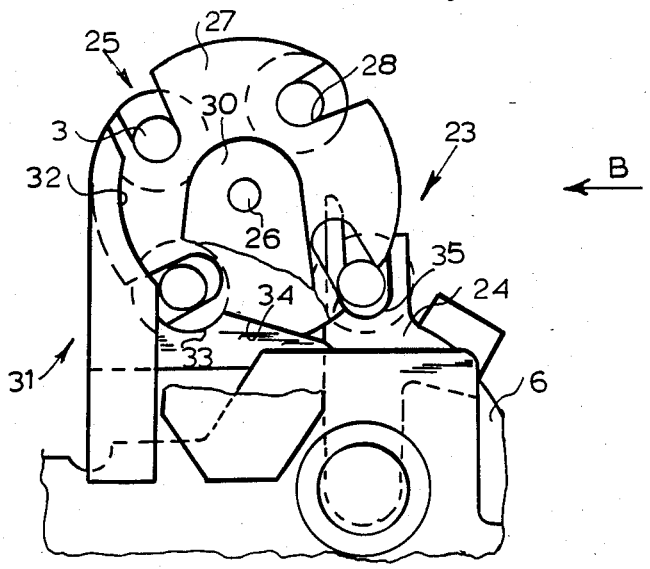
FIG. 2 is an enlarged detail of the device of FIG. 1.
Figure 3:
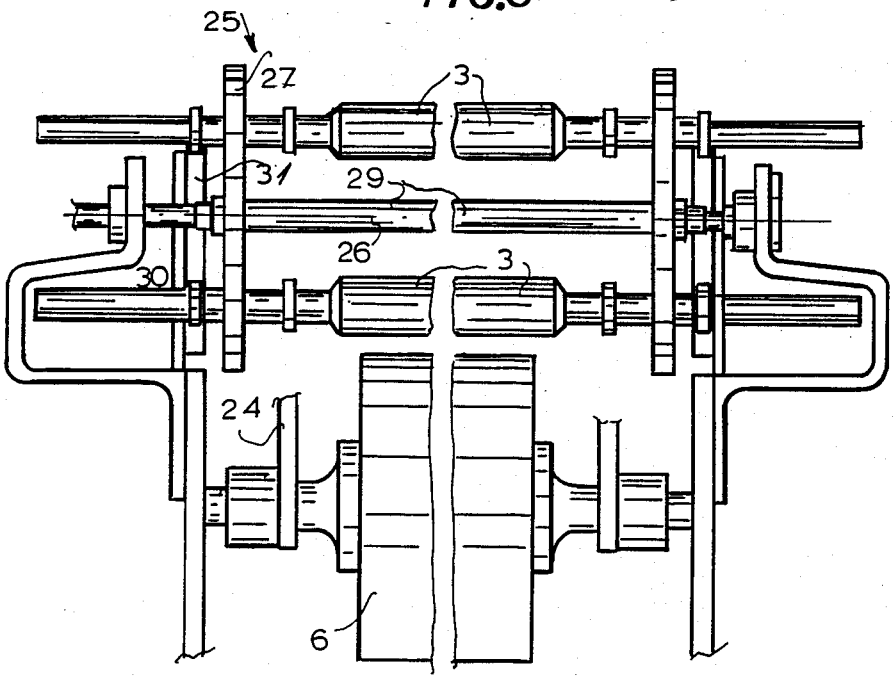
FIG. 3 is a front view of the device of FIG. 2, taken in the direction of the arrow B.

From FIG. 1, it can be seen that in the region of the contact roller 6, a winding core pickup device 23 with two swingable transfer arms 24 is provided, and that a winding core magazine 25 is assigned to this winding core pickup device 23. The winding core magazine 25 has two oppositely located magazine disks 27, rotatable about a horizontal axis with corresponding receiving portions or pockets 28 for the ends of the roll cores 3. From FIG. 3 it can be seen that the magazine disks 23 are arranged on a common shaft 29, which is suitably supported in the lateral walls 30 of the device. Especially from FIG. 2 it can be seen that to each magazine disk a basically L-shaped guiding element 31 is assigned, which has on the vertical shank of the L an arched edge 32, following the path of the roll-core receiving portions 28. This edge 32 extends to an assembly trough 33 and continues beyond the trough with a downward inclination 34, representing a discharge path. The winding core delivering device 23 has winding core transfer arms. The winding device 23 has winding arms 24, which are swingable around the horizontal axis of the contact roller 6. These are so arranged that, for the purpose of introducing a new roll core 3 from underneath, grasp the ends of a roll core 3 in the assembly position with the receiving end portions 35. Rotation of the magazine disks 27 and engagement of the roll cores from below by the arms 24 causes the roll core to engage the previously sectioned foil web and to pass along the inclined edge 34 into contact with the contact roller 6. Here, the swingable arms 4 of the device receive the roll core 3. At the same time, a further roll core 3 of the roll core magazine 25 reaches the assembly trough 33. This entire process repeats itself, when a further foil roll is finished and another winding process has to be initiated on a new roll core 3. It is self-understood that the roll-core receiving portions 28 of the magazine disks 27 and the receiving portions in the receiving ends 35 of the winding arms 24 are designed to afford sufficient freedom of movement, for instance by having a slotlike shape, so that during the described motion sequences no constraint is created and that during the entrainment of the magazine disks 27, the ends of the respective roll core 3 to be introduced can be removed from the assembly trough 33, namely can be brought onto the inclined level 34 during the swinging motion of the winding arms 24.

What is claimed is:

1. An apparatus for winding a foil web of synthetic material on a roll core, comprising:

a winding-core magazine having a pair of disks rotatable about a magazine axis and formed with core-receiving pockets, said winding-core magazine entraining successive roll cores along a circular path;

a pair of generally L-shaped guide elements respectively extending along peripheries of said disks, each of said guide elements having along a substantially vertical leg of a respective L, an arcuate portion extending downwardly along said circular path for guiding said cores as said cores are entrained along said path by said disks, a trough at a lower end of each arcuate portion for receiving successive cores from said pockets, and, along a generally horizontal leg of the L, an inclined edge directed downwardly away from said trough;

a contact roller rotatable about a contact-roller axis parallel to said magazine axis, toward which said inclined edges are directed and over which said web is guided for applying a severed end of said web to a core displaced toward said contact roller;

a pair of core-transfer arms swingable about said contact-roller axis for engagement with opposite ends of a roll core in said troughs and displacing an engaged roll core together with said disks along said inclined edges, over said contact roller and to a pickup location beyond an apex of said contact roller;

a pair of swingable roll-winding arms receiving said ends of a roll core at said location from said core-transfer arms and provided with drive means of rotating a roll core on said swingable roll-winding arms to wind said web into a roll on a core on said swingable roll-winding arms;

an actuating piston-and-cylinder arrangement operatively connected with said swingable roll-winding arms for displacing said ends of said swingable roll-winding arms toward and away from said contact roller and controlling a contact pressure of said contact roller with a roll wound on a core held by the ends of said swingable roll-winding arms.

* * * * *